United States Patent [19]

Spencer

[11] Patent Number: 4,870,898

[45] Date of Patent: Oct. 3, 1989

[54] TRASH COMPACTOR WITH PIVOTING PLATEN PORTION

[76] Inventor: William D. Spencer, 3 Hillwinds, Brattleboro, Vt. 05301

[21] Appl. No.: 246,213

[22] Filed: Sep. 19, 1988

[51] Int. Cl.[4] ..... B30B 15/06; B30B 1/18

[52] U.S. Cl. ..... 100/53; 100/215; 100/229 A; 100/233; 100/256; 100/289; 100/295

[58] Field of Search ..... 100/52, 53, 214, 215, 100/226, 229 A, 233, 246, 256, 289, 290, 295, 281, 283, 287, 272

[56] References Cited

U.S. PATENT DOCUMENTS

| | | | |
|---|---|---|---|
| 3,079,856 | 3/1963 | Swartz | 100/290 X |
| 3,482,463 | 12/1969 | Huydts et al. | 290/289 X |
| 3,659,427 | 5/1972 | Harza | 100/290 X |
| 3,727,546 | 4/1973 | McKinney | 100/229 A |
| 3,831,513 | 8/1974 | Tashman | 100/229 A X |
| 3,838,635 | 10/1974 | Hardy | 100/290 X |
| 4,007,678 | 2/1977 | Gustavsson et al. | 100/290 X |
| 4,147,100 | 4/1979 | Dykstra | 100/52 X |
| 4,188,872 | 2/1980 | Chrablow | 100/233 X |
| 4,241,652 | 12/1980 | Smedlund | 100/289 X |
| 4,548,132 | 10/1985 | Moon | 100/52 |

FOREIGN PATENT DOCUMENTS

| | | | |
|---|---|---|---|
| 2202156 | 5/1979 | Fed. Rep. of Germany | 100/229 A |

*Primary Examiner*—Harvey C. Hornsby
*Assistant Examiner*—Stephen F. Gerrity
*Attorney, Agent, or Firm*—Chapin, Neal & Dempsey

[57] ABSTRACT

A trash compactor has a reciprocable platen with a pivotable outer leaf. An electric motor rotates with a telescoping drive-screw mechanism which reciprocably drives the platen in its compaction and retraction strokes. A toggle linkage mechanism automatically pivots the outer leaf to an upwardly inclined orientation from a coplanar relationship with the platen in response to upward and downward reciprocable movement of the platen by the drive-screw.

4 Claims, 2 Drawing Sheets

TRASH COMPACTOR WITH PIVOTING PLATEN PORTION

BACKGROUND OF THE INVENTION

This invention relates to a trash compacting apparatus capable of handling large quantities of waste materials, such as paper, paper board and plastics which are compacted for disposal of in an efficient and safe manner.

Over the last several years, there have been a number of trash compactors of different constructional characteristics proposed for dealing with trash disposal problems. U.S. Pat. No. 3,838,635; U.S. Pat. No. 4,130,054 and U.S. Pat. No. 4,288,872 disclose three different waste compactors each having a compacting ram with a pivotable feature to facilitate placing waste material under the ram in its retracted position.

The present invention, which of necessity has many constructional features in common with previously disclosed trash compactors, is characterized by a highly effective ram drive-screw mechanism and a simple, economical and reliable means for controlling a tiltable ram portion not found in trash compactors previously available.

The principal object of this invention is to provide an improved trash compactor having a simple but effective drive-screw which reciprocates the trash compacting ram member.

Another object of this invention is to provide an improved trash compactor of the above type which includes a simple but effective mechanism to operate automatically a pivotable portion of the trash compacting ram in response to the reciprocable movement of the ram.

The above and other objects of this invention will be more readily apparent from the following detailed descriptions read in conjunction with the following drawings in which.

Figure 1:
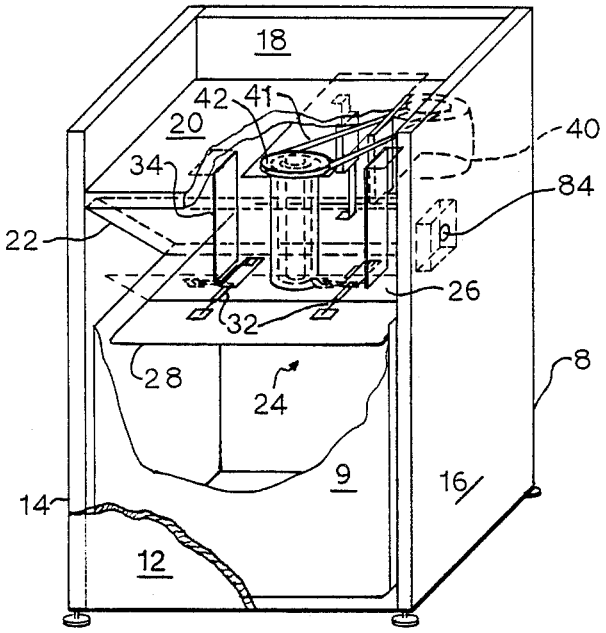
FIG. 1 is a perspective view of a trash compactor of the type embodying my invention, with parts cut away to reveal the interior thereof.

Referring now in detail to the drawings, a trash compactor of the type embodying this invention is shown generally at 8 in FIG. 1. The compactor comprises a housing having a bottom wall 10, front wall 12, side walls 14 and 16, a back wall 18 and a top wall 20.

The front wall includes a fixed lower portion 12 swingable about a vertical axis for the insertion and removal of a trash container depicted at 9 in FIG. 1. The upper portion of the front wall comprises a swingable door 22 which is pivotable along a horizontal hinge disposed at its upper edge to provide easy axis to the interior of the housing for placing trash into the container 9 disposed within the compactor. A solenoid mechanism is provided at 11 so that the door will be automatically locked "closed" when the compactor is activated, as will hereinafter be more fully described.

Figure 2:
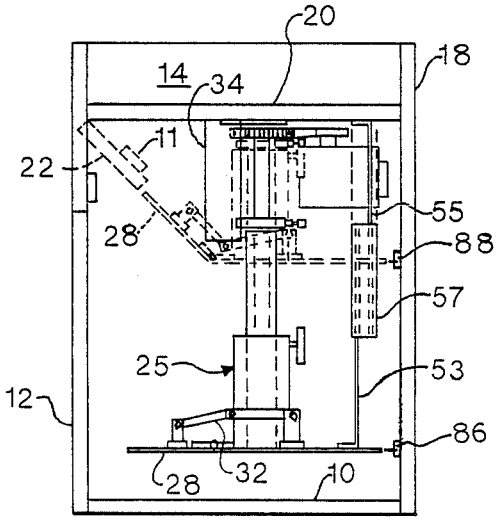
FIG. 2 is a side elevational view of the compactor.
Figure 6:
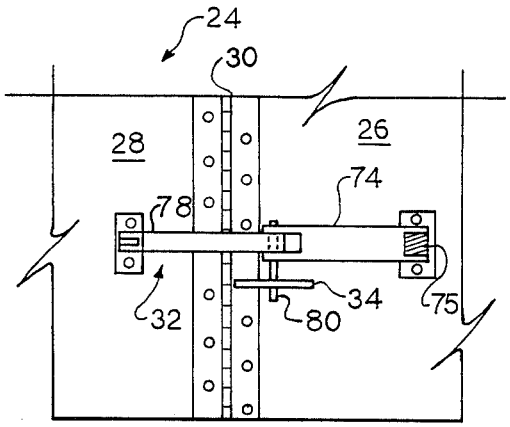
FIG. 6 is a top plan view of the mechanism of FIG. 5.

Disposed within the compactor 8 is the compacting means or platen 24 which operates to compact the trash into a dense mass, convenient for disposal. The mechanism comprises a reciprocably drive means, as indicated generally at 25 in FIG. 2 and FIG. 4 of the drawing. The platen 24 includes an inner portion 26 and outer rectangular leaf portion 28 pivotable upwardly and downwardly to and from a coplanar orientation with the inner portion 26 of the platen. The pivotable leaf is secured to the adjacent edge of platen 26 by hinge 30 (FIG. 6). Hinged platen or leaf 28 is adapted to be pivoted through an acute angle of abut 45° so as to provide sufficient clearance to enable trash to be deposited into the compactor through the swinging door 22. This relationship is best illustrated in FIG. 2 where the swinging door 22 and the hinged platen are depicted, by broken lines, as oriented in a coplanar relationship.

Means is also provided to swing the leaf 28 automatically upwardly as the platen 26 is reciprocated upward and downward as the platen is reciprocated downward by ram 25 in a trash compacting stroke. The means comprises two pair of laterally spaced toggle linkages 32 and associated actuator bars 34 which will automatically actuate each toggle in response to its upward and downward reciprocable movement, as will hereafter be more fully described.

Figure 4:
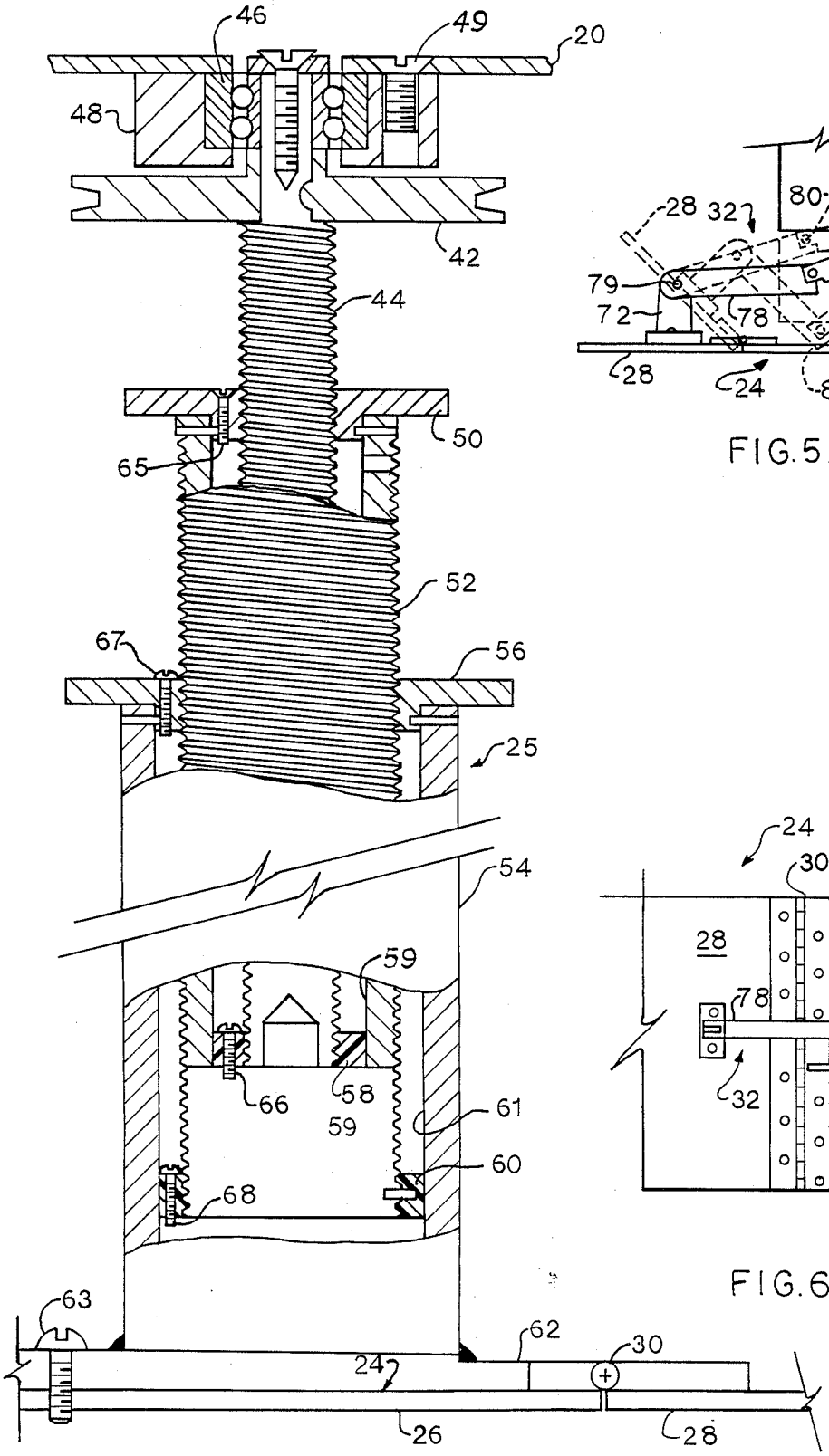
FIG. 4 is an elevational view on an enlarged scale and partly in section to show the drive mechanism used in the compactor.

The platen 24, including its fixed and pivotable leaf portion, is driven vertically in a trash compacting or ram stroke and a retraction stroke to prepare the compactor to receive another load of trash or waste material after the previously compacted mass has been removed from the container 9 through front door 12. The drive means 25 comprises an electric motor 40, drivingly connected by a pulley 41 to a sprocket 42, splined onto drive-screw 44 (FIG. 4). The upper end of the drive-screw 44 is rotatably mounted in ball bearing 46 disposed within a collar 48 secured to the upper wall 20 of the compactor by fasteners, such as illustrated at 49. Drive-screw 44 is externally threaded over its full length and is meshed with a correspondingly threaded cap 50 secured onto the upper end of a second or intermediate drive-screw 52. A drive ram member 54 also provided with an end cap 56 which is internally threaded to mesh with the external threads on the drive-screw 52.

The lower end of drive-screw 44 is provided with an annular collar or ring 58 which may be made of any suitable material, including Nylon or Delrin, having a low coefficient of friction for easy sliding action against the inner cylindrical wall 59 of screw 52. Similarly, the lower end of intermediate drive-screw 52 is also provided at its lower end with a ring 60 which has a sliding fit against the cylindrical inner wall 61 of the cylindrical ram member 54. The lower end of the ram 54 is welded to an attaching flange 62 which is secured by means of screws 63 attached to the fixed planten 26.

As drive-screw 44 is rotated in one direction, clockwise, for example, the externally threaded cylinder 52 is driven downwardly until it reaches the end of its travel at which the lower end of screw 65 contacts the head of screw 66 whereupon cylinder 52 will begin to rotate with drive-screw 44 and the lower cylinder or ram 54 will be driven outwardly until the mechanism is fully telescoped to its maximum length at which screw 67 will contact screw 68. When the drive-motor is reversed or driven counterclockwise, the threaded members will be telescoped upwardly in reverse order until returned to the position depicted in FIG. 1 of the drawing.

Means is also provided to stabilize the reciprocal movement of the compactor platen and in the illustrated embodiment, comprises a pair of opposed guide bars 53 and 55 (FIG. 2). The lower bar 53 is affixed by its outer angle portion to the platen 26 at a point rearwardly of the ram cylinder 54 and adjacent the back edge of the platen. The upper bar 55 is similarly affixed to the upper wall 20 of the housing but is laterally offset so that the two opposing bars are free to move in parallel overlapping relation. The inner free end of each bar is slidably fitted into a channel which extends longitudinally through a guide block 57. The guide block or channel 57 may be formed of any suitable plastic material such as Delrin, which has a low coefficient friction for easy sliding movement of the metal guide bars therein.

Figure 5:
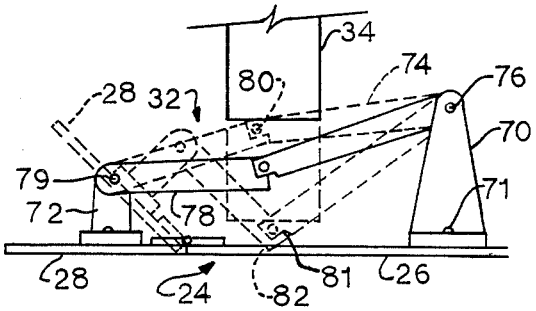
FIG. 5 is a side elevational view showing the mechanism used in the compactor for operating a pivotable portion of the ram.

Toggle link arrangement 32 automatically coordinates the operation of the pivotable leaf 28 with the stroke of the ram or fixed platen 26. The toggle arrangement includes two identical mechanisms equally spaced on opposite sides of the drive ram, thus description of one such mechanism should suffice for a full understanding of the construction and operation of both mechanism. An understanding post or bracket 70 has a base flange secured by any suitable means, such as screws 71 to the platen 26. Another post or bracket 72 is secured in the same manner to the upper surface of hinged platen 28. A linkage 74 is pivotably mounted at its inner end adjacent the upper end of bracket 70 and spring 75 is coiled about the pivot pin 76 and has outwardly extending terminal leg portions. One leg portion is engaged with the bracket 70 and the other is engaged with the underside of the linkage 74 to resiliently urge the linkage upwardly. A second linkage 78 is pivotably mounted at one end to bracket 72 by a pivot pin 79. At the inner ends, the two linkages are pivotably coupled together in a toggle arrangement by a pivot pin 80 (FIG. 6) which extends a substantial distance laterally of the linkages for engagement with actuator bar 34. Adjacent pivot pin 80, the underside of linkage 74 includes a shoulder 81 and linkage 78 is provided with an opposing shoulder 82. The two shoulders are disposed to engage in surface-to-surface contact and to serve as a limit "stop" for the upward pivotable movement of the two linkages, as depicted in the upper, broken line showing of FIG. 5. In this "stop" position, the centerlines or longitudinal axes of the linkages 74 and 78 form an obtuse angle substantially greater than 180°, that is they are angularly oriented well beyond a position of axial alignment. In this "stop" position, the two linkages will hold the hinged platen 28 in its coplanar relation with the fixed planten 26 for the trash compacting function. This obtuse angular relationship of the platens will be released or changed when the platen 24 is raised or retracted vertically by the drive mechanism 25 so that the laterally extending outer portion of each of the pivot pins 80 is brought into contact with the lower edges of each of the actuator bars 34, as best depicted in FIG. 5. Continued upward movement of the platen will result in bars 34, causing the linkages to be pivoted downwardly against the tension of springs 35 until they reach an acute angular relationship, as depicted in FIG. 5. As this occurs, the hinged leaf or platen 28 will be swung upwardly, as depicted in the broken lines showing illustrated in FIGS. 2 and 5. In this position of the platen, the motor 40 will be cut "OFF" and swinging door 22 unlocked, ready for removal of the compacted trash whereby the compactor will be ready for the next cycle of operation.

Figure 3:
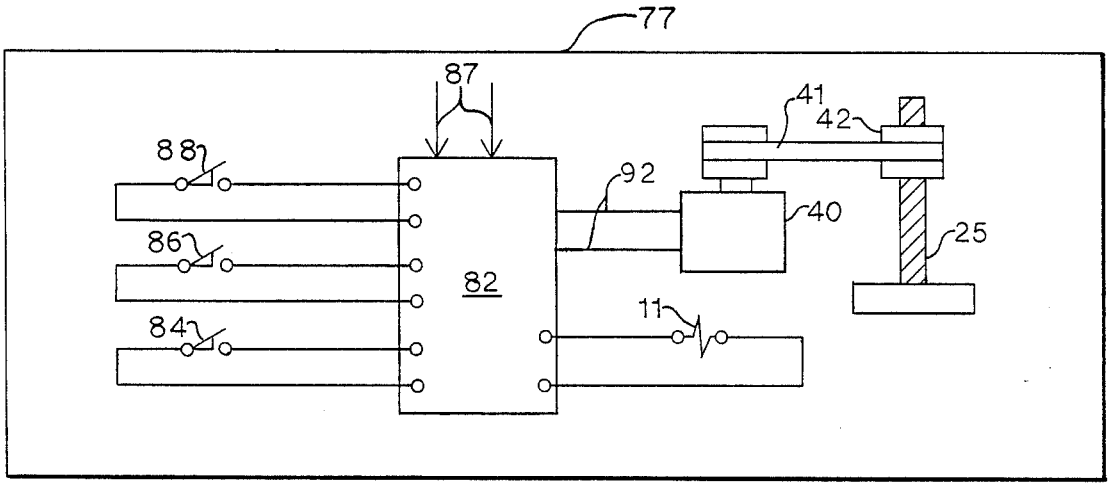
FIG. 3 is a schematic diagram showing an electric circuit used to control the operation of the compactor.

The operation of the trash compactor is controlled by an electronic control system, illustrated generally at 77 in FIG. 3. The system includes the electric drive motor 40 which may be a one-quarter horsepower (¼ HP) induction motor which causes the drive-screw mechanism 25 to drive the ram downwardly to compact the trash and to retract the ram when the compaction step has been completed.

A control unit 82 is provided with alternating current source by conductors 87. Start-switch 84, ram down-switch 86 and ram up-switch 88 are each connected to the control unit. A door lock solenoid 11 is provided so that when the swinging door 22 is closed and the ram switch 84 is actuated, the solenoid 11 will be energized to lock door 22 in its "closed" position. This is a safety precaution to prevent access to the interior of the compactor housing when the ram cycle is in operation.

Preferably, the start-switch is configured or adapted so that it can only be actuated by a special tool or key in order to prevent unauthorized operation of the compactor. The motor 40 is energized by means of leads 92 connected to the control unit 82. When the motor 40 drives in one direction, it causes the ram to drive the platen downwardly until lower limit switch 86 is actuated as the ram reaches the lower end of its compacting stroke. Actuation of limit switch 86 will cause the control unit to "stop" and reverse driving direction of the motor 40, whereby the drive-screw will reverse direction and retract the ram until it reaches the upper limit of its travel at which point the upper limit switch 88 will be actuated to "stop" the drive motor and deenergize the solenoid 11 whereby the door 22 can be opened.

With this invention, I have provided a relatively simple, economical but effective and reliable trash compactor.

Having thus described my invention, what is claimed is:

1. Trash compactor comprising a receptacle for receiving waste material, said receptacle including an upwardly swinging door for insertion of waste therethrough, a vertically reciprocable platen having an upwardly and downwardly pivotable leaf portion disposed adjacent the swinging door to enable trash to be disposed within the receptacle below said platen, a telescopic multi-stage, drive-screw mechanism rigidly connected to said platen to reciprocably raise and lower said platen, an electric motor disposed to drivingly engage the drive-screw mechanism, at least one pair of linkages independent of said drive-screw mechanism and mounted in spanning relation between the platen and the leaf portion thereof to control the upward and downward movement of the pivotable leaf, an actuator member disposed in stationary relation within the compactor and located to engage and trip the linkages to pivot said leaf portion upwardly and downwardly in response to the reciprocable raising and lowering of the platen.

2. Trash compactor as set forth in claim 1, in which the linkages of each pair are connected together by a pivot pin in a toggle mechanism and in which an actuator member is disposed to engage said pivot pin to actuate each toggle mechanism when the platen is moved upwardly to a position adjacent said swinging door.

3. Trash compactor as set forth in claim 2, in which the drive-screw mechanism includes a threaded drive-screw having inner and outer end portions rotatably supported in depending relation within the receptacle, at least one cylindrical driven member having a cap member with internal threads meshed with the threads of the drive-screw, said one cylindrical member being externally threaded to drive another cylindrical member having upper and lower ends, the outer end portion of said drive-screw having an annular bearing disposed in sliding contact with the inner wall of said one cylindrical member, the lower end of the other cylindrical member being secured to the platen to reciprocate the same vertically in response to rotation of the drive-screw.

4. Trash compactor as set forth in claim 2, in which said toggle mechanism is disposed on the upper surface of the platen and said pivot pin includes a laterally extending portion and said actuator member includes a depending bar having a lower edge disposed to engage each pivot pin extension at a height within said compactor approximately corresponding to the raised position of said platen.

* * * * *